US009410218B2

(12) United States Patent
Murao et al.

(10) Patent No.: US 9,410,218 B2
(45) Date of Patent: Aug. 9, 2016

(54) METHOD FOR OPERATING A BLAST FURNACE

(75) Inventors: Akinori Murao, Fukuyama (JP); Daiki Fujiwara, Fukuyama (JP); Shiro Watakabe, Fukuyama (JP)

(73) Assignee: JFE Steel Corporation (JP)

( * ) Notice: Subject to any disclaimer, the term of this patent is extended or adjusted under 35 U.S.C. 154(b) by 206 days.

(21) Appl. No.: 14/131,592

(22) PCT Filed: Jul. 11, 2012

(86) PCT No.: PCT/JP2012/004463

§ 371 (c)(1),
(2), (4) Date: Jan. 24, 2014

(87) PCT Pub. No.: WO2013/011661

PCT Pub. Date: Jan. 24, 2013

(65) Prior Publication Data

US 2014/0131929 A1 May 15, 2014

(30) Foreign Application Priority Data

Jul. 15, 2011 (JP) ..... 2011-156956
Jul. 15, 2011 (JP) ..... 2011-156959

(51) Int. Cl.
*C21B 7/00* (2006.01)
*C21B 5/00* (2006.01)
*C21B 7/16* (2006.01)

(52) U.S. Cl.
CPC . *C21B 5/00* (2013.01); *C21B 5/003* (2013.01); *C21B 7/00* (2013.01); *C21B 7/163* (2013.01)

(58) Field of Classification Search
CPC ..... C21B 5/003; C21B 7/163
USPC ..... 266/265, 268
See application file for complete search history.

(56) References Cited

U.S. PATENT DOCUMENTS 5,522,916 A * 6/1996 Karinthi ..... C21B 5/003 266/221
2008/0211148 A1* 9/2008 Harrison ..... C21B 7/163 266/265
2009/0325110 A1 12/2009 Mahoney et al.
2014/0131929 A1* 5/2014 Murao ..... C21B 5/003 266/44

FOREIGN PATENT DOCUMENTS

EP 0 922 772 6/1999
JP 64-28312 1/1989
JP 04-268003 9/1992

(Continued)

OTHER PUBLICATIONS

Supplementary European Search Report dated Aug. 4, 2015 of corresponding European Application No. 12814820.2.

(Continued)

*Primary Examiner* — Scott Kastler
(74) *Attorney, Agent, or Firm* — DLA Piper LLP (US)

(57) ABSTRACT

A method of operating a blast furnace comprising two or more lances that inject reducing agents from a tuyere including injecting a solid reducing agent and a flammable reducing agent from different lances; and arranging a position of an end of the lance that injects the flammable reducing agent closer to a near side in a injecting direction by more than 0 to 50 mm than a position of an end of the lance that injects the solid reducing agent.

16 Claims, 9 Drawing Sheets

(56) References Cited

FOREIGN PATENT DOCUMENTS

| | | |
|---|---|---|
| JP | 06-128614 | 5/1994 |
| JP | 10-226806 | 8/1998 |
| JP | 11-241109 | 9/1999 |
| JP | H11-315310 | 11/1999 |
| JP | 2000-178614 | 6/2000 |
| JP | 2006-241586 | 9/2006 |
| JP | 2006-291251 | 10/2006 |
| JP | 2007-162038 | 6/2007 |
| KR | 10-2009-0130471 | 12/2009 |
| WO | 94/20642 | 9/1994 |

OTHER PUBLICATIONS

Korean Office Action dated Feb. 17, 2016 of corresponding Korean Application No. 2014-7000749 along with a Concise Statement of Relevance of Office Action in English.

* cited by examiner

FIG. 6

| ITEM | LANCE STRUCTURE | | TRAVEL/DIFFUSION STATE BLOWING-IN DIRECTION | EVALUATION | | | | |
|---|---|---|---|---|---|---|---|---|
| | AXIAL CROSS SECTION | | | TEMPERATURE | COMBUSTION POSITION | CHAR | DIFFUSIBILITY | OVERALL |
| SINGLE-WALL LANCE (ONLY PC) | PC+N2 | ID:ϕ16.7 | INJECT INJECT | — | — | — | — | — |
| DOUBLE-WALL LANCE (1) (INSIDE PC, OUTSIDE LNG) | LNG PC+N2 LNG | ID:ϕ25.0 ID:ϕ16.7 | INJECT INJECT (1) AMBIENT TEMPERATURE RISE ⇒HEATING SPEED INCREASE | △ | ○ | △ | △ | △ |
| DOUBLE-WALL LANCE (2) (INSIDE LNG, OUTSIDE PC) | PC+N2 LNG PC+N2 | ID:ϕ25.0 ID:ϕ12.7 | INJECT INJECT (2) INNER-SIDE LNG COMBUSTION ⇒DIFFUSIBILITY ENHANCED | ○ | △ | ○ | ◎ | ○ |

METHOD FOR OPERATING A BLAST FURNACE

TECHNICAL FIELD

This disclosure relates to a method of operating a blast furnace that makes it possible to increase productivity and reduce unit consumption of reducing agent by increasing combustion temperature as a result of injecting a solid reducing agent such as pulverized coal, and a flammable reducing agent such as LNG (liquefied natural gas), from a blast furnace tuyere.

BACKGROUND

In recent years, global warming due to an increase in the amount of emission of carbon dioxide is a problem. Even in the steel industry, reducing the amount of emitted $CO_2$ is an important issue. Therefore, in recent operations of blast furnaces, low reducing agent rate (low RAR) operations are greatly encouraged. (The reducing agent rate is the total amount of reducing agent injected from a tuyere and coke charged from the top of a furnace, per 1 ton of pig iron that is manufactured). In a blast furnace, coke and pulverized coal injected from a tuyere are primarily used as reducing agents. To achieve a low reducing agent rate and, thus, suppress the amount of emission of carbon dioxide, it is effective to replace, for example, coke with a reducing agent having a high hydrogen content such as waste plastic, LNG, and heavy oil. Japanese Unexamined Patent Application Publication No. 2006-291251 discusses that, when two or more lances that inject reducing agents from a tuyere are used and a flammable reducing agent such as LNG, and a solid reducing agent such as pulverized coal, are injected from different lances, the lances are disposed so that an extension line of a lance that injects the flammable reducing agent and an extension line of a lance that injects the solid reducing agent do not cross each other. According to Japanese Unexamined Patent Application Publication No. 11-241109, when a lance that supplies a reducing gas is disposed in front of, that is, closer to a blast furnace side by 50 to 10 mm in a injecting direction than a lance that supplies a solid reducing agent such as pulverized coal, pressure loss at an end of a tuyere and a blow pipe is reduced so that stability of a furnace condition is increased.

Although, compared to a conventional method of injecting only pulverized coal from a tuyere, the method of operating a blast furnace in Japanese Unexamined Patent Application Publication No. 2006-291251 has the effect of increasing combustion temperature and reducing a unit consumption of reducing agent, it can be further improved. In the method of operating a blast furnace in the Japanese Unexamined Patent Application Publication No. 11-241109, since the reducing gas is not sufficiently preheated/its temperature is not sufficiently raised, the effect of raising the temperature of pulverized coal due to the formation of a combustion field is small, and oxygen at a point where the pulverized coal is ignited and starts burning is consumed, as a result of which the combustion of the pulverized coal may be hindered.

It could therefore be helpful to provide a method of operating a blast furnace that makes it possible to further increase combustion temperature and reduce unit consumption of reducing agents.

SUMMARY

We thus provide a method of operating a blast furnace, comprising:

providing two or more lances that inject reducing agents from a tuyere;

injecting a solid reducing agent and a flammable reducing agent from different lances; and situating a position of an end of the lance that injects the flammable reducing agent closer to a near side in a injecting direction by more than 0 to 50 mm than a position of an end of the lance that injects the solid reducing agent.

It is desirable that the position of the end of the lance that injects the flammable reducing agent be situated closer to the near side in the injecting direction by 10 to 30 mm than the position of the end of the lance that injects the solid reducing agent.

It is desirable that an outlet flow velocity at the lance that injects the solid reducing agent and an outlet flow velocity at the lance that injects the flammable reducing agent be 20 to 120 m/sec.

It is desirable that the lance that injects the solid reducing agent be a double wall lance, the solid reducing agent be injected from an inner tube of the double wall lance, a combustion-supporting gas be injected from an outer tube of the double wall lance, and the flammable reducing agent be injected from a single wall lance. It is desirable to use oxygen-enriched air having an oxygen concentration of 50% or higher as the combustion-supporting gas.

It is desirable that an outlet flow velocity at the outer tube that injects the combustion-supporting gas of the double wall lance and an outlet flow velocity at the single wall lance that injects the flammable reducing agent be 20 to 120 m/sec.

It is desirable that the solid reducing agent be pulverized coal.

It is desirable that the pulverized coal, serving as the solid reducing agent, be mixed with waste plastic, refuse derived reducing agent, organic resource, or discarded material.

It is desirable that, with a proportion of the pulverized coal, serving as the solid reducing agent, being 80 mass % or higher, the waste plastic, the refuse derived reducing agent, the organic resource, or the discarded material be used to mix with the pulverized coal.

It is desirable that the flammable reducing agent be LNG, shale gas, town gas, hydrogen, converter gas, blast-furnace gas, or coke-oven gas.

As a consequence, when the flows of the flammable reducing agent and the solid reducing agent injected from different lances overlap each other and the flammable reducing agent contacts the combustion-supporting gas and undergoes combustion earlier, explosive diffusion occurs and the temperature of the solid reducing agent is drastically increased. This makes it possible to drastically increase the combustion temperature and, thus, to reduce a unit consumption of the reducing agent.

When the position of an end of a lance that injects a flammable reducing agent is situated closer to the near side in the injecting direction by 10 to 30 mm than the position of an end of a lance that injects a solid reducing agent, the effect of raising the temperature of solid reducing agent particles is increased and combustion temperature is further increased.

When the outlet flow velocity at the lance that injects a solid reducing agent and the outlet flow velocity at the lance that injects a flammable reducing agent are 20 to 120 m/sec, deformation of the lances caused by a rise in temperature can be prevented from occurring.

BRIEF DESCRIPTION OF THE DRAWINGS

FIG. 6 shows combustion experiment results.

REFERENCE SIGNS LIST

Figure 1:
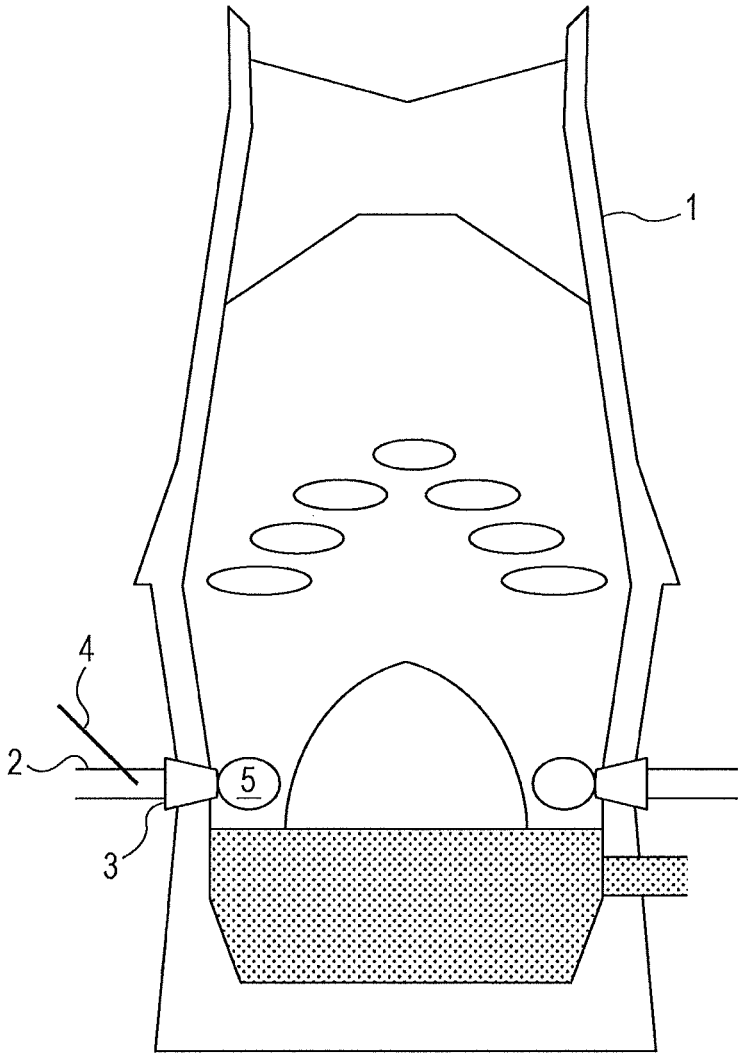
FIG. 1 is a vertical sectional view of an example of a blast furnace to which a method of operating a blast furnace is applied.

1 blast furnace
2 blow pipe
3 tuyere
4 lance
5 raceway
6 pulverized coal (solid reducing agent)
7 coke
8 char
9 LNG (flammable reducing agent)

DETAILED DESCRIPTION

Next, a method of operating a blast furnace is described with reference to the drawings.

FIG. 1 is an overall view of a blast furnace to which the method of operating a blast furnace is applied. As shown in FIG. 1, a blow pipe 2 that blows hot air connects to a tuyere 3 of a blast furnace 1. A lance 4 is set to extend through the blow pipe 2. A combustion space, which is called a "raceway" 5, exists at a coke deposit layer located in front of the tuyere 3 in a direction in which hot air is injected. In this combustion space, reduction of iron ore, that is, the production of pig iron is primarily performed.

Figure 2:
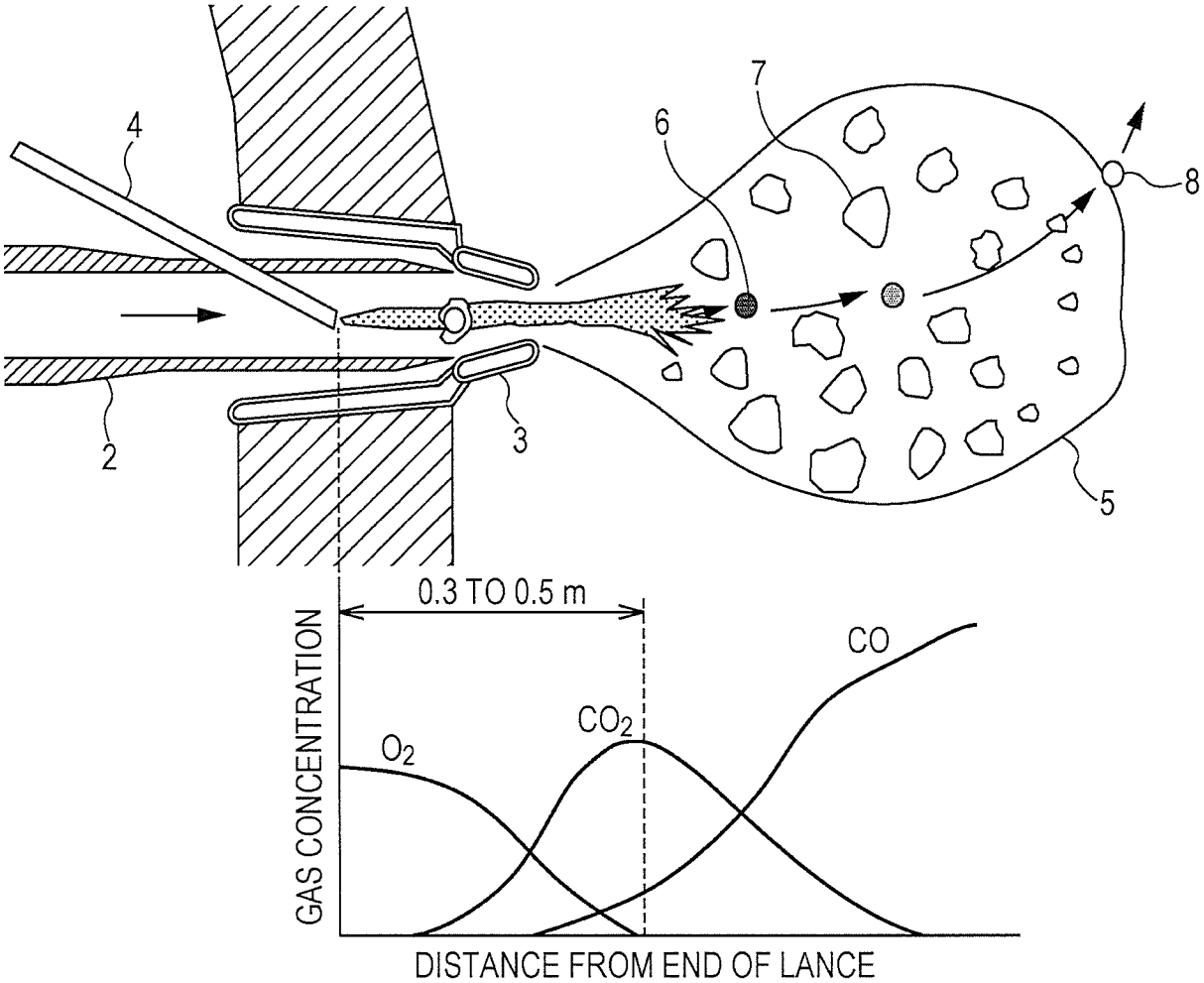
FIG. 2 illustrates a combustion state when only pulverized coal is injected from a lance in FIG. 1.

FIG. 2 illustrates a combustion state when only pulverized coal 6, serving as a solid reducing agent, is injected from the lance 4. The pulverized coal 6 passes through the tuyere 3 from the lance 4 and is injected into the raceway 5. Volatile matter and fixed carbon of the pulverized coal 6 undergo combustion along with coke 7, and the volatile matter is emitted to remain an aggregate of carbon and ash, which is generally called char. The char is discharged as unburned char 8 from the raceway. The hot blast velocity in front of the tuyere 3 is approximately 200 m/sec, and the region of existence of $O_2$ in the raceway 5 from an end of the lance 4 is approximately 0.3 to 0.5 m. Therefore, it is necessary to virtually improve contact efficiency with $O_2$ (diffusibility) and raise the temperature of pulverized coal particles at a level of $1/1000$ sec.

Figure 3:
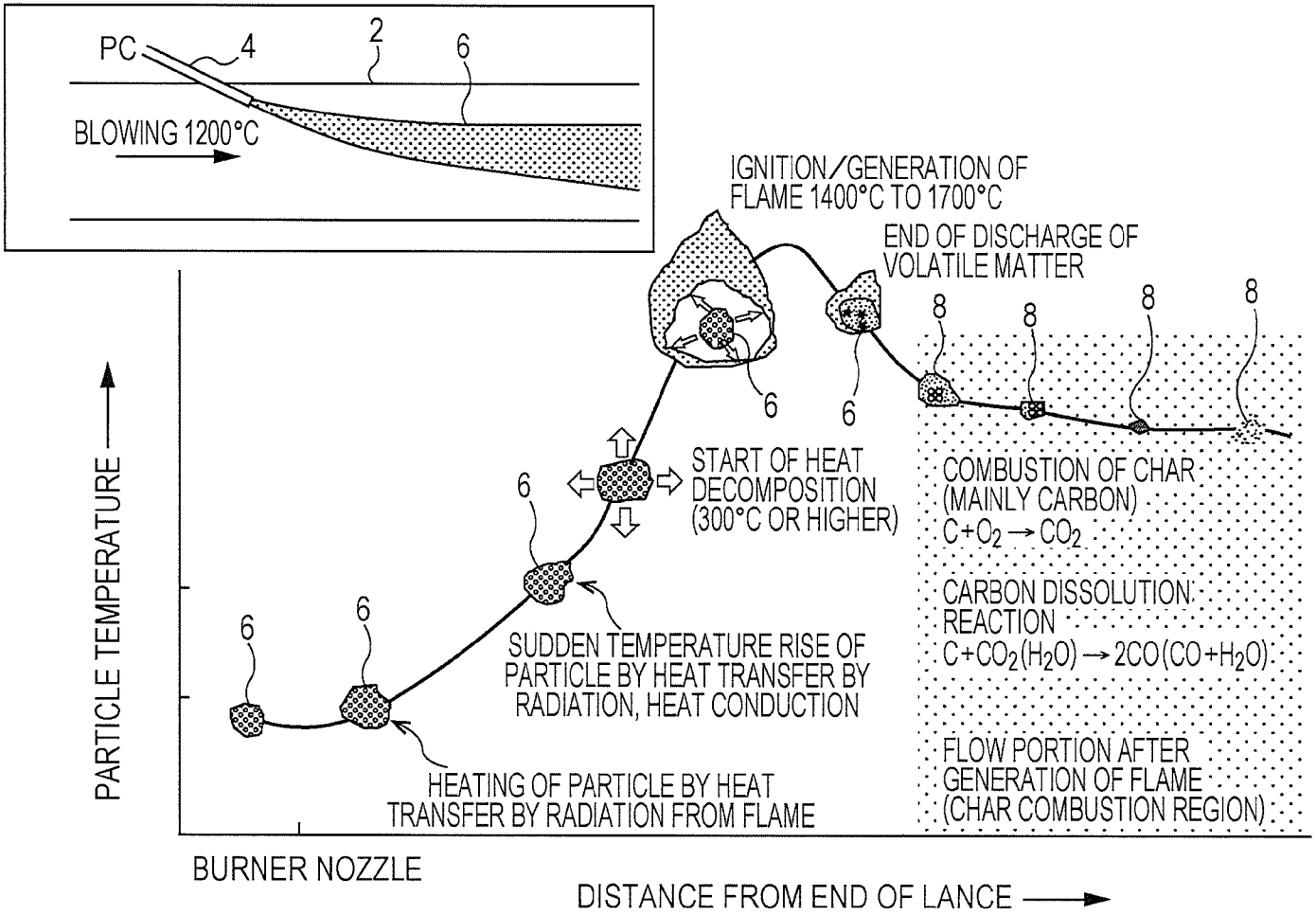
FIG. 3 illustrates a combustion mechanism of the pulverized coal in FIG. 2.

FIG. 3 illustrates a combustion mechanism when only the pulverized coal (in FIG. 3, PC) 6 is injected into the blow pipe 2 from the lance 4. Particles of the pulverized coal 6 that have been injected into the raceway 5 from the tuyere 3 are heated by heat transfer by radiation from a flame in the raceway 5. Further, by heat transfer by radiation and heat conduction, the temperature of the particles is suddenly increased, and heat decomposition is started from the time when the temperature has been raised to at least 300° C. so that the volatile matter is ignited. This causes a flame to be generated, and the combustion temperature reaches 1400 to 1700° C. If the volatile matter is discharged, the aforementioned char 8 is formed. The char 8 is primarily fixed carbon so that what is called a carbon dissolution reaction also occurs along with the combustion reaction.

Figure 4:
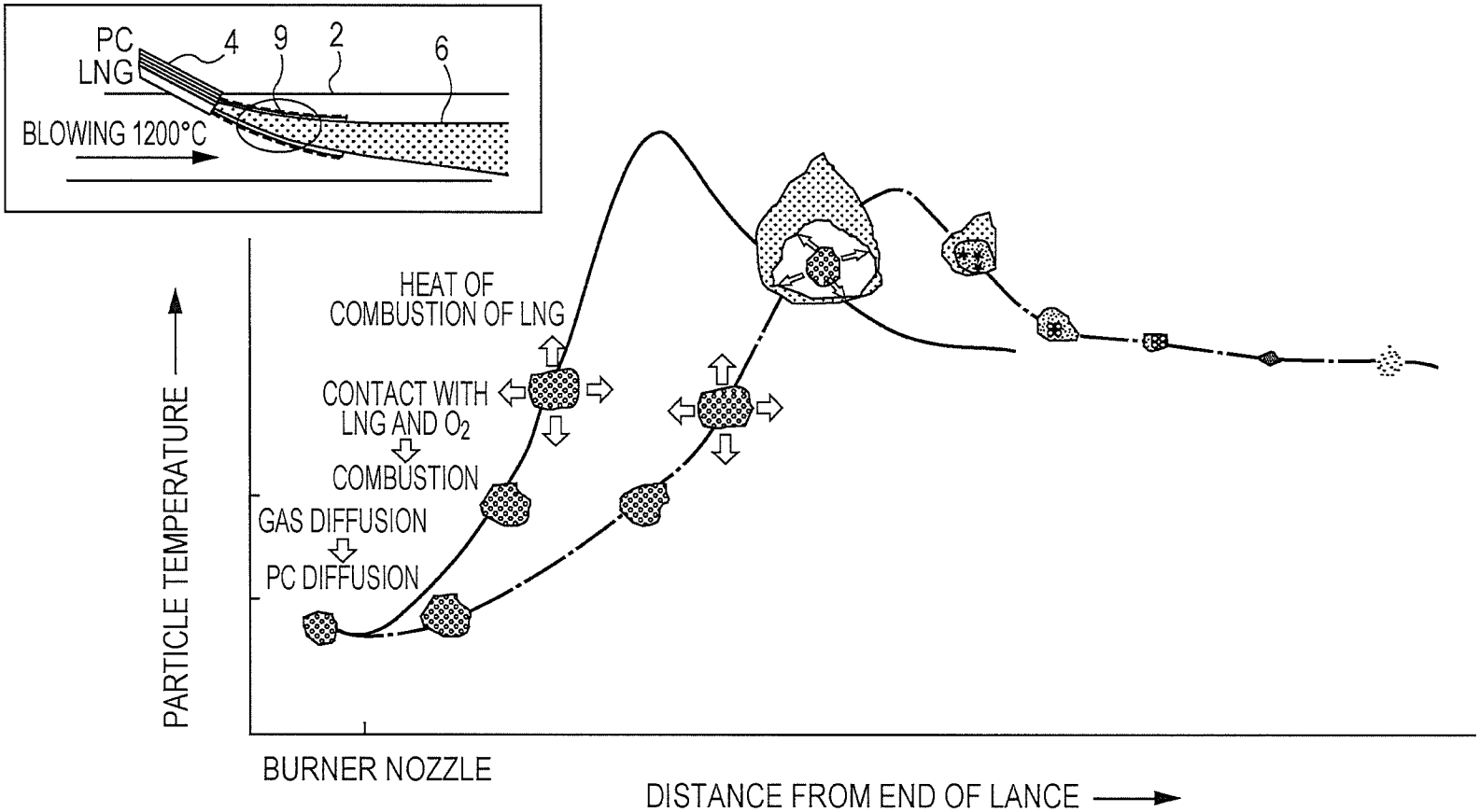
FIG. 4 illustrates a combustion mechanism when pulverized coal and LNG are injected.

FIG. 4 illustrates a combustion mechanism when the pulverized coal 6 and LNG 9, serving as a flammable reducing agent, are injected into the blow pipe 2 from the lance 4. The method of injecting the pulverized coal 6 and the LNG 9 is that when they are simply injected in parallel. The two-dot chain line in FIG. 4 is shown with the combustion temperature when only pulverized coal is injected as shown in FIG. 3 being used as a reference. We believe that, when the pulverized coal and the LNG are injected at the same time in this way, the LNG, which is a gas, precedingly undergoes combustion and combustion heat thereof suddenly heats the pulverized coal to raise its temperature. This causes the combustion temperature at a location close to the lance to further increase.

Figure 5:
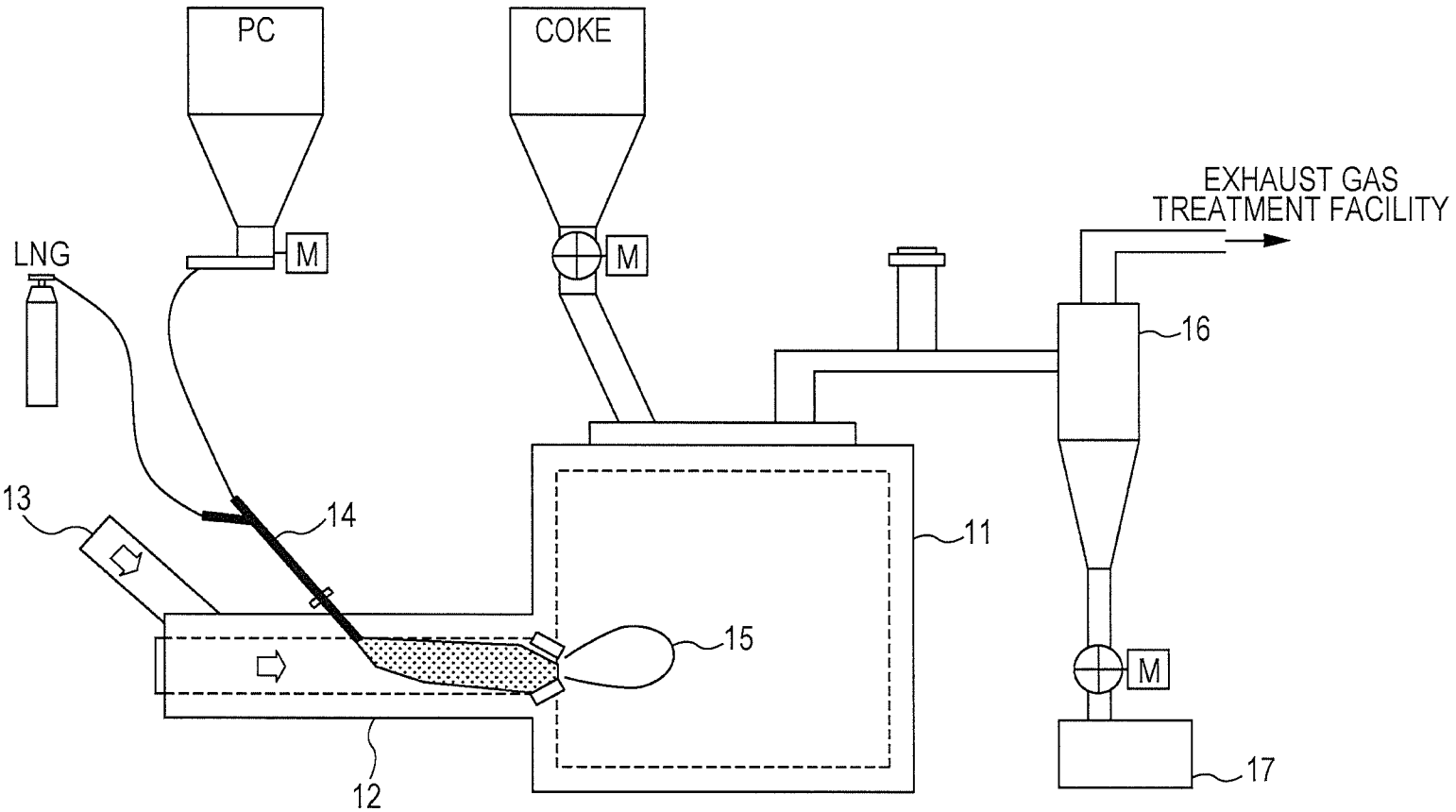
FIG. 5 illustrates a combustion experimental device.

On the basis of such knowledge, a combustion experiment was conducted using a combustion experimental device shown in FIG. 5. An experimental reactor 11 is filled with coke. The inside of a raceway 15 can be viewed from a viewing window. It is possible to blow a predetermined amount of hot air generated by a combustion burner 13 into the experimental reactor 11 when a lance 14 is inserted into a blow pipe 12. In this blow pipe 12, it is also possible to adjust the oxygen enrichment amount in the air blast. The lance 14 can be used to inject either one of the pulverized coal and the LNG into the blow pipe 12. Exhaust gas generated in the experimental reactor 11 is separated into exhaust gas and dust by a separator 16 that is a cyclone. The exhaust gas is sent to an exhaust gas treatment facility such as an auxiliary furnace, and the dust is collected by a collecting box 17.

In the combustion experiment, two types of lances, a single wall lance and a double wall lance, were used for the lance 4. Diffusibility, combustion state of unburned char, combustion position, and combustion temperature were measured using a two-color thermometer from a viewing window for the following cases. These cases are where only pulverized coal was injected using a single wall lance, the case in which a double wall lance was used to inject pulverized coal from an inner tube of the double wall lance and LNG was injected from an outer tube of the double wall lance, and the case in which LNG was injected from the inner tube of the double wall lance and pulverized coal was injected from the outer tube of the double wall lance. As is well known, a two color thermometer is a radiation thermometer that measures temperature by making use of heat radiation (movement of electromagnetic waves from a high-temperature object to a low-temperature object). The two color thermometer is a wavelength distribution type in which temperature is determined by measuring a change in a wavelength distribution temperature while focusing on a shift of the wavelength distribution towards shorter wavelengths as the temperature increases. Since, in particular, the two color thermometer obtains a wavelength distribution, it measures radiant energy in two wavelengths and measures the temperature from the ratio. The combustion state of unburned char was determined by collecting the unburned char with a probe at a position of 150 mm and 300 mm from an end of the lance 14 at the blow pipe 12 of the experimental furnace 11, performing resin embedding, polishing, and then measuring the void ratio in the char by image analysis.

The pulverized coal contained 77.8% of fixed carbon (FC), 13.6% of volatile matter (VM), and 8.6% of ash. The injecting condition was 29.8 kg/h (equivalent to 100 kg per 1 t of molten iron). The condition for injecting LNG was 3.6 kg/h (equivalent to 5 $Nm^3$/h, 100 kg per 1 t of molten iron). The blowing conditions were: blowing temperature=1200° C., flow rate=300 $Nm^3$/h, flow velocity=70 m/s, and $O_2$ enrichment+5.5 (oxygen concentration of 26.5%, enrichment of 5.5% with respect to oxygen concentration of 21% in air). In a system of transporting powder, that is, pulverized coal with a small amount of gas (high-concentration transport), the solid-gas ratio is 10 to 25 kg/$Nm^3$, whereas, in a system of transporting it with a large amount of gas (low-concentration transport), the solid-gas ratio is 5 to 10 kg/$Nm^3$. Air may be used for the transport gas.

In evaluating the experimental results, evaluations were made for the case in which pulverized coal was injected from an inner tube of a double wall lance and LNG was injected from an outer tube and the case in which LNG was injected from the inner tube of the double wall lance and pulverized coal was injected from the outer tube. The evaluations were performed with reference to the combustion temperature, the combustion position, the combustion state of unburned char, and diffusibility (primarily pulverized coal) in the case in which only pulverized coal was injected from a single tube. In the evaluations, results that were about the same as those of the case in which only pulverized coal was injected are indicated by a triangle, results that showed slight improvements compared to the results of the case in which only pulverized coal was injected are indicated by a circle, and results that showed considerable improvements compared to the results of the case in which only pulverized coal was injected are indicated by a double circle.

FIG. 6 shows the results of the above-described combustion experiment. As is clear from FIG. 6, when pulverized coal is injected from the inner tube of the double wall lance and LNG is injected from the outer tube, improvements are made regarding the combustion position, whereas no changes are seen regarding the other items. We believe this to be because, although LNG at the outer side of the pulverized coal contacts $O_2$ earlier and undergoes combustion quickly and the combustion heat thereof increases the heating speed of the pulverized coal, $O_2$ is consumed in the combustion of LNG and, therefore, $O_2$ required for the combustion of the pulverized coal is reduced, as a result of which the combustion temperature is not sufficiently raised and the combustion state of the unburned char is also not improved.

In contrast, when LNG is injected from the inner tube of the double wall lance and pulverized coal is injected from the outer tube, improvements are made regarding the combustion temperature and the combustion state of the unburned char and considerable improvements are made regarding diffusibility, whereas there are no changes seen regarding the combustion position. This is thought to be because, although it takes time to diffuse $O_2$ up to the inner-side LNG via an outer-side pulverized coal region, if the inner-side flammable LNG undergoes combustion, explosive diffusion occurs so that the pulverized coal is heated by the combustion heat of LNG and the combustion temperature is also increased, as a result of which the combustion state of the unburnt char is also improved.

Figure 7:
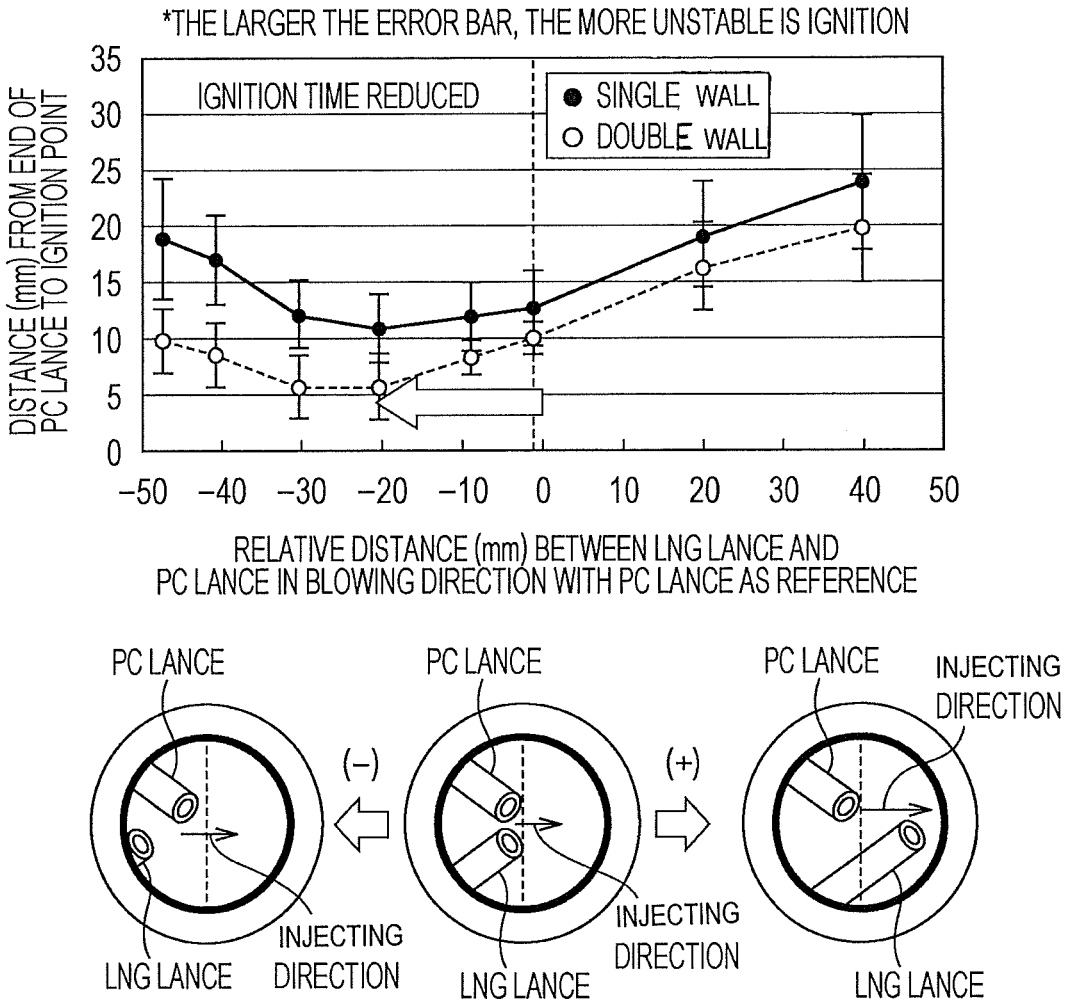
FIG. 7 shows the distance up to an ignition point when the relative distance between lances in a injecting direction is changed.

From the experimental results, we believe that, if LNG in the air blast is caused to undergo combustion earlier and pulverized coal is injected into the air blast thereafter, combustion efficiency is further increased. Therefore, using the above-described combustion experimental device, the position of an end of a lance that injects LNG was changed in a injecting direction with respect to the position of an end of a lance that injects pulverized coal in a blow pipe at a tuyere, to measure the distance to an ignition point from the end of the lance that injects pulverized coal. The measurement results are shown in FIG. 7. "PC lance" in FIG. 7 indicates the lance (single tube or double tube) that injects pulverized coal and "LNG lance" in FIG. 7 indicates the lance that injects LNG. The distances of both the lances in the injecting direction are expressed with the relative position between the LNG lance and the PC lance in the injecting direction with the PC lance serving as a reference being such that when, in the injecting direction, the position of the end of the lance that injects LNG is situated in front of the position of the end of the lance that injects pulverized coal, the relative position is positive, whereas, when, in the injecting direction, it is positioned closer to a near side in the injecting direction, the relative position is negative. The larger an error bar, the more unstable is the ignition.

Figure 8:
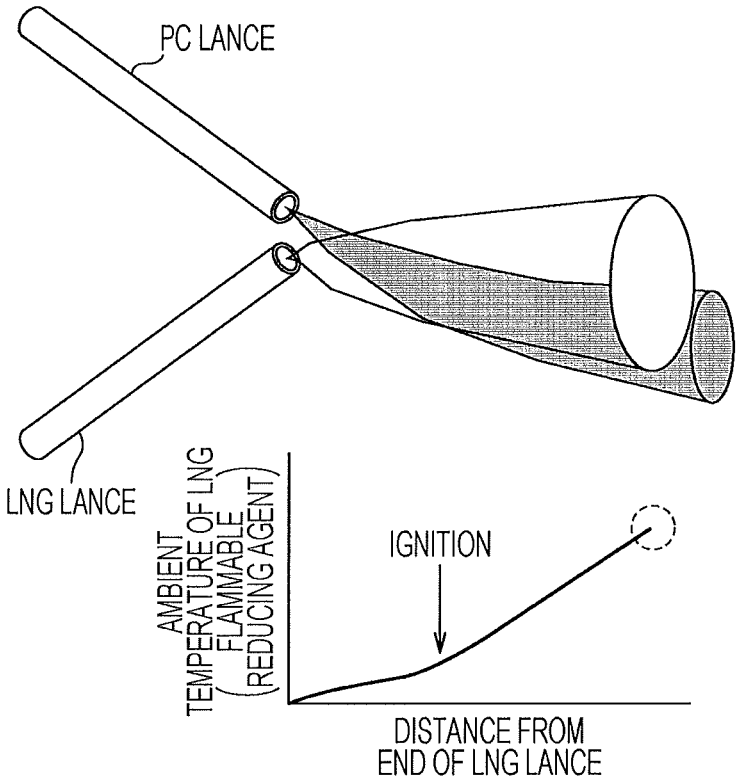
FIG. 8 is a conceptual view of the flow of pulverized coal and the flow of LNG when the relative distance between the position of an end of a lance that injects pulverized coal and the position of an end of a lance that injects LNG is 0.
Figure 9:
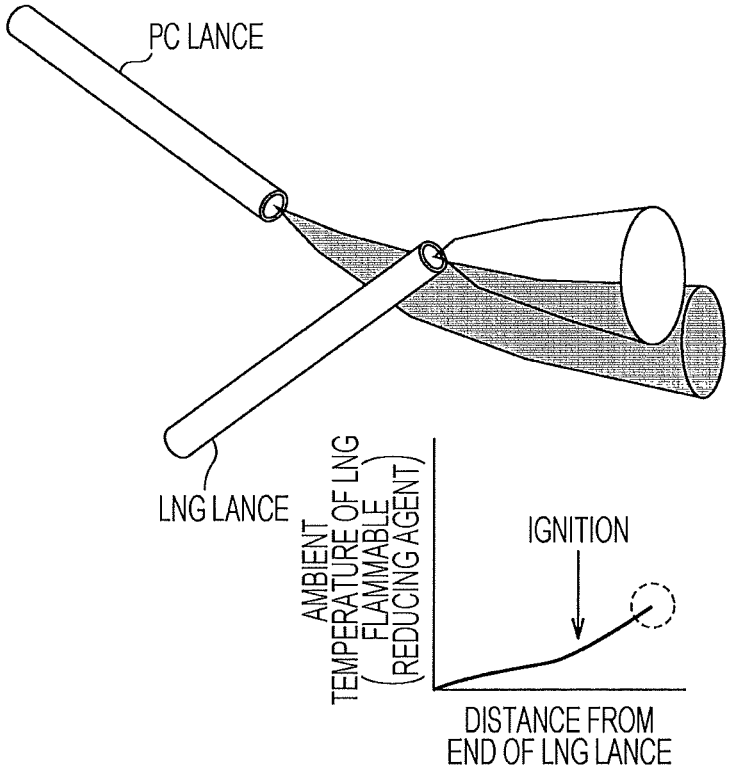
FIG. 9 is a conceptual view of the flow of pulverized coal and the flow of LNG when, in a injecting direction, the position of the end of the lance that injects LNG is situated in front of the end of the lance that injects pulverized coal.
Figure 10:
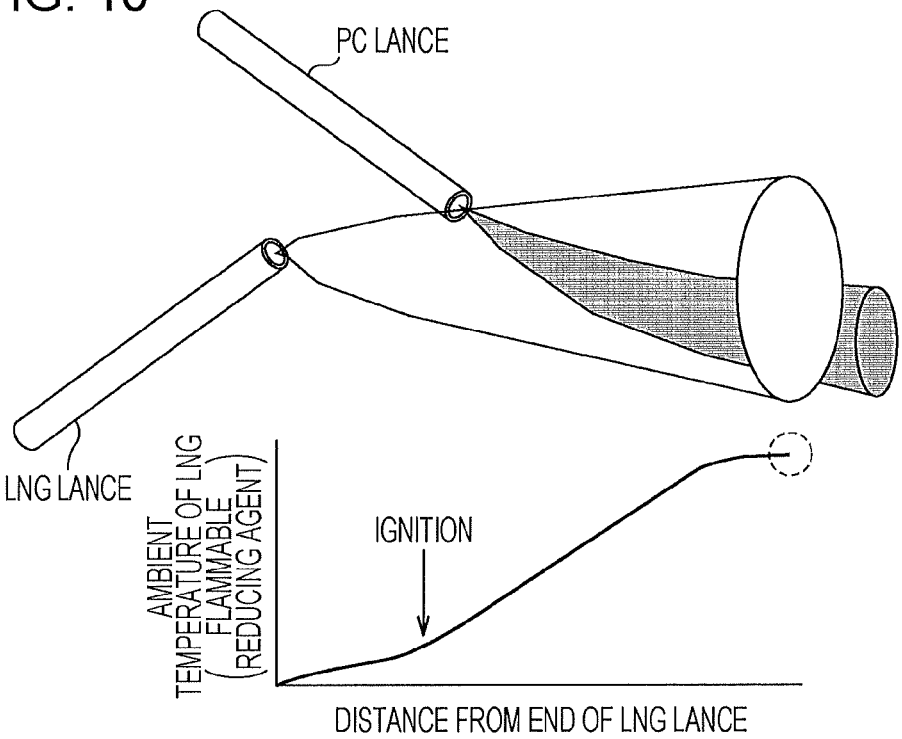
FIG. 10 is a conceptual view of the flow of pulverized coal and the flow of LNG when the position of the end of the lance that injects LNG is situated closer to a near side in an injecting direction than the position of the end of the lance that injects pulverized coal.

FIG. 8 is a conceptual view of the flow of pulverized coal and the flow of LNG when the relative distance between the position of the end of the lance that injects pulverized coal and the position of the end of the lance that injects LNG is 0. FIG. 9 is a conceptual view of the flow of pulverized coal and the flow of LNG when, in the injecting direction, the position of the end of the lance that injects LNG is situated in front of the position of the end of the lance that injects pulverized coal. FIG. 10 is a conceptual view of the flow of pulverized coal and the flow of LNG when the position of the end of the lance that injects LNG is situated closer to the near side in the injecting direction than the position of the end of the lance that injects pulverized coal.

As is clear from FIG. 7, the distance to the ignition point when, in the injecting direction, the position of the end of the lance that injects LNG is equivalent to the position of the end of the lance that injects pulverized coal or the distance to the ignition point when it is situated closer to the near side in the injecting direction, that is, the ignition time is reduced. We believe this be because, since LNG supplied earlier or at the same time tends to undergo combustion than pulverized coal, the LNG undergoes combustion earlier so that combustion heat of the LNG heats the pulverized coal, as a result of which combustion efficiency is increased and combustion temperature is also increased. For example, as shown in FIG. 9, if, in the injecting direction, the position of the end of the lance that injects LNG is situated in front of the position of the end of the lance that injects pulverized coal, the ambient temperature of the LNG that has been injected is low so that the effect of raising the temperature of pulverized coal particles existing at the same position is low.

In contrast, as shown in FIG. 10, if, in the injecting direction, the position of the end of the lance that injects LNG is situated closer to the near side than the position of the end of the lance that injects pulverized powder, the ambient temperature of the LNG that has been injected becomes a maximum temperature so that the effect of raising the temperature of the pulverized coal particles existing at the same position is maximum. Therefore, in the injecting direction, the position of the end of the lance that injects a flammable reducing agent is situated closer to the near side by more than 0 to 50 mm than the lance that injects a solid reducing agent. On the basis of how it is expressed in the figure, it is, more desirably, −10 to −30 mm.

A double wall lance in which an inner tube and an outer tube are concentrically disposed may be used for the lance that injects pulverized coal. In this case, pulverized coal is injected from the inner tube and oxygen is injected from the outer tube. Since, as mentioned above, oxygen is consumed by the combustion of LNG, if a flow of pulverized coal and a flow of oxygen are injected so that the flow of oxygen is positioned at the outer side of the flow of pulverized coal, it is possible to provide oxygen required for combustion of pulverized coal. The case in which the lance that injects pulverized coal uses a double wall lance is the same as the case in which a single wall lance is used. The distance to the ignition point when, in the injecting direction, the position of the end of the lance that injects LNG is equivalent to the position of the end of the lance that injects pulverized coal or the distance to the ignition point when it is situated closer to the near side in the injecting direction, that is, the ignition time is reduced. We believe this is because, since LNG that is supplied earlier or at the same time tends to undergo combustion than pulverized coal, the LNG undergoes combustion earlier so that combustion heat of the LNG heats the pulverized coal, as a result of which combustion efficiency is increased and combustion temperature is also increased. Therefore, pulverized coal is injected from the inner tube of the double wall lance, oxygen, that is, combustion-supporting gas, is injected from the outer tube, LNG is injected from the single wall lance, and the position of the end of the double wall lance that injects pulverized coal is situated closer to the near side in the injecting direction by more than 0 to 50 mm than the position of the end of the single wall lance that injects LNG. On the basis of how it is expressed in the figure, it is, more desirably, −10 to −30 mm.

As the combustion temperature increases as described above, a lance tends to be exposed to high temperatures. The lance is, for example, a stainless steel tube. Obviously, although the lance is subjected to water cooling that uses what is called a water jacket, it cannot cover locations up to ends of the lance. In particular, we found that end portions of the lance that cannot be reached by water cooling are deformed by heat. When the lance is deformed, that is, is bent, pulverized coal and LNG cannot be injected to a desired portion, and replacement of the lance, which is a consumable, is hindered. In addition, the flow of pulverized coal may change and strike the tuyere, in which case the tuyere may become damaged. When the lance is bent and clogged and, as a result, gas no longer flows through the lance, the lance is eroded, in which case the blow pipe may become damaged. If the lance is deformed or worn, it is no longer possible to ensure a combustion temperature such as that mentioned above and, therefore, a unit consumption of reducing agent also cannot be reduced.

To cool a lance that cannot be water-cooled, the lance can only be cooled by heat dissipation using gas that is supplied to its interior. We believe that, if the lance itself is cooled by heat-dissipation to the gas that flows in the interior thereof, the flow velocity of the gas influences the temperature of the lance. Therefore, we measured the temperature of the surface of a lance by variously changing the flow velocity of the gas injected from the lance. In an experiment, using a double wall lance, $O_2$ was injected from an outer tube of the double wall lance and pulverized coal was injected from an inner tube, and the gas flow velocity was adjusted by changing the supply amount of $O_2$ injected from the outer tube. The $O_2$ may be oxygen-enriched air. Oxygen-enriched air of 2% or more, or, desirably, of 10% or more is used. By using oxygen-enriched air, combustibility of pulverized coal, in addition to cooling, is enhanced. The measurement results are shown in FIG. 11.

As the outer tube of the double wall lance, a steel tube, called a 20A schedule 5S tube, was used. As the inner tube of the double wall lance, a steel tube, called a 15A schedule 90 tube, was used, and the temperature of the surface of the lance was measured by variously changing the total flow velocity of $N_2$ and $O_2$ injected from the outer tube. "15A" and "20A" refer to the outside diameters of steel tubes that are specified in JIS G 3459. 15A corresponds to an outside diameter of 21.7 mm, and 20A corresponds to an outside diameter of 27.2 mm. "Schedule" refers to wall thickness of steel tubes specified in JIS G 3459. 20A schedule 5S corresponds to a wall thickness of 1.65 mm, and 15A schedule 90 corresponds to a wall thickness of 3.70 mm. In addition to stainless steel, ordinary steel may be used. The outside diameter of a steel tube in this case is specified in JIS G 3452, and the wall thickness thereof is specified in JIS G 3454.

Figure 11:
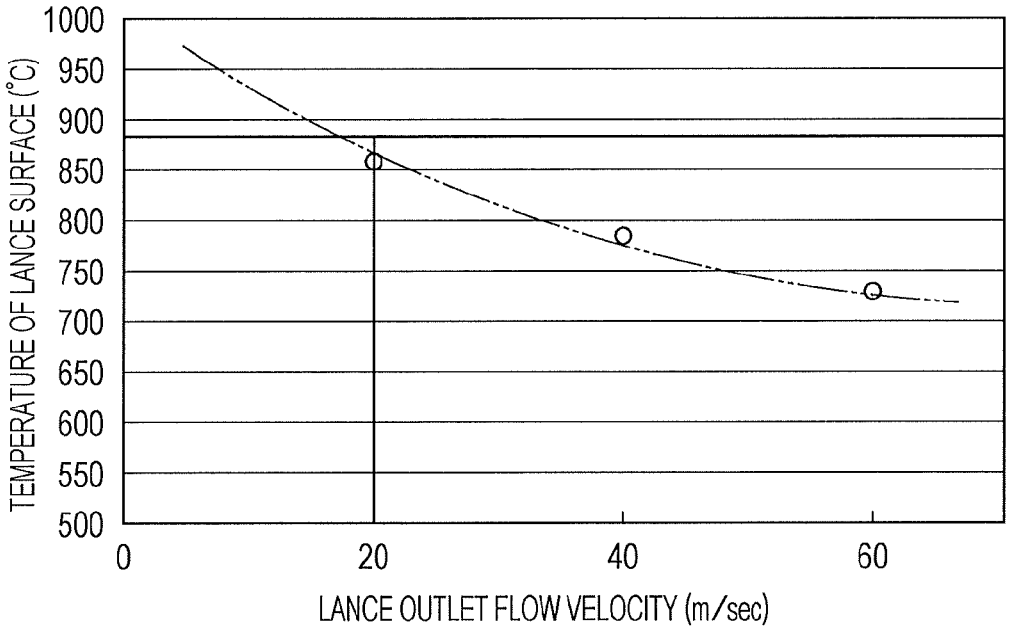
FIG. 11 illustrates the relationship between the outlet flow velocity at a lance and the surface temperature of the lance.

As shown by the alternate long and two short dashes line in FIG. 11, as the flow velocity of gas that is injected from the outer tube of the double wall lance is increased, the temperature of the surface of the lance is inversely proportionally reduced. When steel tubes are used in the double wall lance, if the surface temperature of the double wall lance exceeds 880° C., creep deformation occurs, thereby causing the double wall lance to bend. Therefore, an outlet flow velocity at the outer tube of the double wall lance, in which a 20A schedule 5S steel tube is used for the outer tube of the double wall lance and whose surface temperature is 880° C. or lower, is 20 m/sec or higher. If the outlet flow velocity at the outer tube of the double wall lance is 20 m/sec or higher, the double wall lance is not deformed or bent.

In contrast, if the outlet flow velocity at the outer tube of the double wall lance exceeds 120 m/sec, this is not practical from the viewpoint of operation costs of a facility. Therefore, the upper limit of the outlet flow velocity at the outer tube of the double wall lance is 120 m/sec. As a result, since the same actions occur at end portions of single wall lances that cannot be similarly reached by water cooling, the outlet flow velocity at the single wall lance is also 20 to 120 m/sec. Since heat load on a single wall lance is less than that on a double wall lance, the outlet flow velocity is set at 20 m/sec or higher as necessary.

Although, in the example, the average particle diameter of pulverized coal is 10 to 100 μm, when combustibility is to be ensured and supply from a lance and suppliability to a lance are considered, it is desirably 20 to 50 μm. When the average particle diameter of pulverized coal is less than 20 μm, the combustibility is excellent. However, the lance tends to be clogged when the pulverized coal is transported (gas is transported). When it exceeds 50 μm, the combustibility of pulverized coal may be reduced.

The solid reducing agent to be injected may primarily contain pulverized coal with waste plastic, refuse derived fuel (RDF), organic resource (biomass), or discarded material mixed therewith. When a mixture is used, it is desirable that the ratio of pulverized coal with respect to the whole solid reducing agent be 80 mass % or higher. That is, the heat quantities resulting from reactions of pulverized coal differ from those resulting from reactions of, for example, waste plastic, refuse derived fuel (RDF), organic resource (biomass), and discarded material. Therefore, if the ratios with which they are used approach each other, combustion tends to be uneven, as a result of which operation tends to become unstable. In addition, compared to pulverized coal, the heat quantities resulting from combustion reactions of, for example, waste plastic, refuse derived fuel (RDF), organic resource (biomass), and discarded material are low. Therefore, when they are injected in large amounts, the substitution efficiency with respect to the solid reducing agent fed from the top of the furnace is reduced. Consequently, it is desirable that the proportion of pulverized coal be 80 mass % or higher.

Waste plastic, refuse derived fuel (RDF), organic resource (biomass), and discarded material may be mixed with pulverized coal as granules that are not more than 6 mm, desirably, not more than 3 mm. The proportion with respect to pulverized coal is such that they are mixable with the pulverized coal by causing them to merge with the pulverized coal pneumatically transported by transport gas. They may be used by being previously mixed with pulverized coal.

Further, although, in the example, a description is given using LNG as a flammable reducing agent, it is also possible to use town gas. As flammable reducing agents other than town gas and LNG, in addition to propane gas and hydrogen, converter gas, blast-furnace gas, and coke-oven gas, generated at steel mills, may be used. Shale gas may be used as an equivalent to LNG. Shale gas is a natural gas extracted from shale layers. Since shale gas is produced at places that are not existing gas fields, shale gas is called unconventional natural gas.

Accordingly, in the method of operating a blast furnace according to the example, when two or more lances that inject reducing agents from the tuyere are used and the position of an end of a lance that injects LNG (flammable reducing agent) is equivalent to or is situated closer to the near side in the injecting direction than the position of an end of a lance that injects pulverized coal (solid reducing agent), the LNG (flammable reducing agent) contacts $O_2$ and undergoes combustion earlier so that explosive diffusion occurs and the temperature of the pulverized coal (solid reducing agent) is drastically increased. This makes it possible to drastically increase the combustion temperature and, thus, to reduce the unit consumption of reducing agent.

When the position of an end of a lance that injects LNG (flammable reducing agent) is situated closer to the near side in the injecting direction by 10 to 30 mm than the position of an end of a lance that injects pulverized coal (solid reducing agent), the effect of raising the temperature of pulverized coal (solid reducing agent particles) is increased and combustion temperature is further increased.

When the outlet flow velocity of gas that is injected from a lance is 20 to 120 m/sec, deformation of the lance caused by a rise in temperature can be prevented from occurring.

Although, in the example, two lances that inject reducing agents are used, any number of lances may be used as long as the number of lances is two or more. In addition, double wall lances may be used for the lances. If double wall lances are used, a combustion-supporting gas such as oxygen, and a flammable reducing agent may be injected. What is required is that the lances be disposed so that an axial line that extends from an end of the lance that injects a flammable reducing agent and is that of this lance and an axial line that extends from an end of the lance that injects a solid reducing agent and is that of this lance cross each other so that main flows of the flammable reducing agent and the solid reducing agent that are injected overlap each other and so that the position of the end of the lance that injects a flammable reducing agent is equivalent to or is situated closer to the near side in the injecting direction than the position of the end of the lance that injects a solid reducing agent.

The invention claimed is:

1. A method of operating a blast furnace comprising:

providing two or more lances that inject reducing agents from a tuyere;

injecting a solid reducing agent and a flammable reducing agent from different lances; and arranging an end of the lance that injects the flammable reducing agent upstream in the tuyere relative to an end of the lance that injects the solid reducing agent by a distance between more than 0 mm and less than or equal to 50 mm.

2. The method according to claim 1, wherein a position of the end of the lance that injects the flammable reducing agent is arranged upstream in the tuyere relative to the end of the lance that injects the solid reducing agent by a distance between more than or equal to 10 mm and less than or equal to 30 mm.

3. The method according to claim 1, wherein an outlet flow velocity at the lance that injects the solid reducing agent and an outlet flow velocity at the lance that injects the flammable reducing agent are 20 to 120 m/sec.

4. The method according to claim 1, wherein the lance that injects the solid reducing agent is a double wall lance, the solid reducing agent is injected from an inner tube of the double wall lance, a combustion-supporting gas is injected from an outer tube of the double wall lance, and the flammable reducing agent is injected from a single wall lance.

5. The method according to claim 4, wherein an outlet flow velocity at the outer tube that injects the combustion-supporting gas of the double wall lance and an outlet flow velocity at the single wall lance that injects the flammable reducing agent are 20 to 120 m/sec.

6. The method according to claim 1, wherein the solid reducing agent is pulverized coal.

7. The method according to claim 6, wherein the pulverized coal, serving as the solid reducing agent, is mixed with waste plastic, refuse derived reducing agent, organic resource, or discarded material.

8. The method according to claim 7, wherein a proportion of the pulverized coal to the solid reducing agent is 80 mass % or higher; and the waste plastic, the refuse derived reducing agent, the organic resource, or the discarded material is used to mix with the pulverized coal.

9. The method according to claim 1, wherein the flammable reducing agent is LNG, shale gas, town gas, hydrogen, converter gas, blast-furnace gas, or coke-oven gas.

10. The method according to claim 2, wherein an outlet flow velocity at the lance that injects the solid reducing agent and an outlet flow velocity at the lance that injects the flammable reducing agent are 20 to 120 m/sec.

11. The method according to claim 2, wherein the lance that injects the solid reducing agent is a double wall lance, the solid reducing agent is injected from an inner tube of the double wall lance, a combustion-supporting gas is injected from an outer tube of the double wall lance, and the flammable reducing agent is injected from a single wall lance.

12. The method according to claim 3, wherein the lance that injects the solid reducing agent is a double wall lance, the solid reducing agent is injected from an inner tube of the double wall lance, a combustion-supporting gas is injected from an outer tube of the double wall lance, and the flammable reducing agent is injected from a single wall lance.

13. The method according to claim 2, wherein the solid reducing agent is pulverized coal.

14. The method according to claim 3, wherein the solid reducing agent is pulverized coal.

15. The method according to claim 4, wherein the solid reducing agent is pulverized coal.

16. The method according to claim 5, wherein the solid reducing agent is pulverized coal.

* * * * *